US006297438B1

(12) United States Patent
Por Paul

(10) Patent No.: US 6,297,438 B1
(45) Date of Patent: Oct. 2, 2001

(54) TOY MUSICAL DEVICE

(76) Inventor: Tong Kam Por Paul, 24/F, Flat C, Block 1, Victoria Centre, 15 Watson Road, Hong Kong (HK)

( * ) Notice: Subject to any disclaimer, the term of this patent is extended or adjusted under 35 U.S.C. 154(b) by 0 days.

(21) Appl. No.: 09/627,587

(22) Filed: Jul. 28, 2000

(51) Int. Cl.[7] ..... G10H 7/00
(52) U.S. Cl. ..... 84/600; 84/743; 446/397
(58) Field of Search ..... 84/600, 644, 670, 84/723, 743; 446/397

(56) References Cited

U.S. PATENT DOCUMENTS 4,662,260 * 5/1987 Rumsey .
4,995,294 * 2/1991 Kashio et al. ..... 84/743 X
5,058,480 * 10/1991 Suzuki et al. ..... 84/600
5,157,213 * 10/1992 Kashio et al. ..... 84/644 X
5,585,584 * 12/1996 Usa ..... 84/600
5,908,996 * 6/1999 Litterst et al. ..... 84/600

* cited by examiner

*Primary Examiner*—Jeffrey Donels
(74) *Attorney, Agent, or Firm*—Schweitzer Cornman Gross & Bondell LLP

(57) ABSTRACT

A toy for generating tone sequences includes a sound-generating circuitry having multiple inputs, the activation of a particular input corresponding to a particular tone. The inputs are connected to a motion sensor whereby a particular motion of the toy is converted into a corresponding sound. The motion sensor may be, for example, a multiple position pendulum switch. Repeated motion of the toy in a plurality of directions allows a tone sequence to be generated. The circuity may include a storage system to allow tone sequences to be retained for later playback.

15 Claims, 5 Drawing Sheets

TOY MUSICAL DEVICE

The present invention relates to a toy musical device and particularly a musical device which allows the user to generate song patterns.

BACKGROUND OF THE INVENTION

Toy products serve multiple purposes. On the one hand, a toy should captivate a child's attention, and retain the child's interest and attention for an extended period. Yet it is also desirable that the toy provide an educational or learning experience for the child. Towards the combination of such ends, there have been developed numerous toys which, while hopefully being of interest to the child, may also impart to the child an educational experience, such as the application of concepts of mathematics, of word meanings and spelling, memory development, and the like.

One popular subject matter for toys which have educational value is music. A toy which generates or plays back musical sounds or notes is both popular with a child and may be perceived as having educational value, as it familiarizes a child with the arts and may instill in the child an appreciation for an enjoyment of music.

There exist a wide variety of sound and tone-generating toys. For example, U.S. Pat. No. 4,341,140 of Jul. 27, 1982 to Ishida discloses a baton-like apparatus which allows the playback of a pre-recorded melody on a note-by-note basis in accordance with the motion of the baton. Such an apparatus, however, does not allow creativity on the part of the user in that it provides no mechanism for development of an original melody.

It is accordingly a purpose of the present invention to provide a sound-generating toy which allows the user to create original melodies by the generation of a series of tones.

A further purpose of the present invention is to provide a music-generating apparatus in the form of a baton which allows an original melody to be generated in accordance with baton motion.

Still a further purpose of the present invention is to provide a toy of the aforementioned type which allows the generation of original sound strings and the storage thereof for subsequent playback.

Yet another purpose of the present invention is to provide a toy of the aforementioned type which can generate sounds of different voices and the like in response to differing directions of motion for the device.

BRIEF SUMMARY OF THE INVENTION

In accordance with the foregoing and other objects and purposes, a toy sound-generating apparatus constructed in accordance with the present invention comprises a housing, sensing means for sensing motion of the housing in a plurality of directions; electronic tone-generating means coupled to the sensing means for generating a particular tone in accordance with the direction sensed; and a speaker for acoustically presenting the sounds. Preferably, the housing is baton-shaped with a handle portion at a first end, whereby a waving motion of the baton in different directions activates the sensing means for tone generation. The tone-generating means may incorporate or be coupled to storage means for retaining the sequence of tones generated by motion of the baton. The generated tone sequence can then be replayed as desired.

BRIEF DESCRIPTION OF THE DRAWINGS

A fuller understanding of the present invention will be accomplished upon review of the following detailed description of a preferred, but nonetheless illustrative embodiment of the invention when reviewed in association with the annexed drawings, wherein.

DETAILED DESCRIPTION OF THE INVENTION

As set forth in the Figures, toy sound-generating apparatus 10 may be in the form of a baton 12 intended to be held at a first end 14. Waving or pivoting motion of the hand and baton causes the generation of a sound in accordance therewith. Pivoting the baton in different directions, such as forward or sideways, causes the generation of different sounds, each one of which is associated with a particular direction. As an alternative to pivoting the hand and baton in different directions, the baton itself can be rotated in the hand, such that a sequence of motions in the same spatial direction correlates with a sequence of motion through different planes extending through the baton. By waving or pivoting the baton in a continuing manner in a series of directions a sound or melody pattern can be developed. The melody is played through an internal speaker and can be simultaneously stored by the apparatus for later playback.

Figure 1:
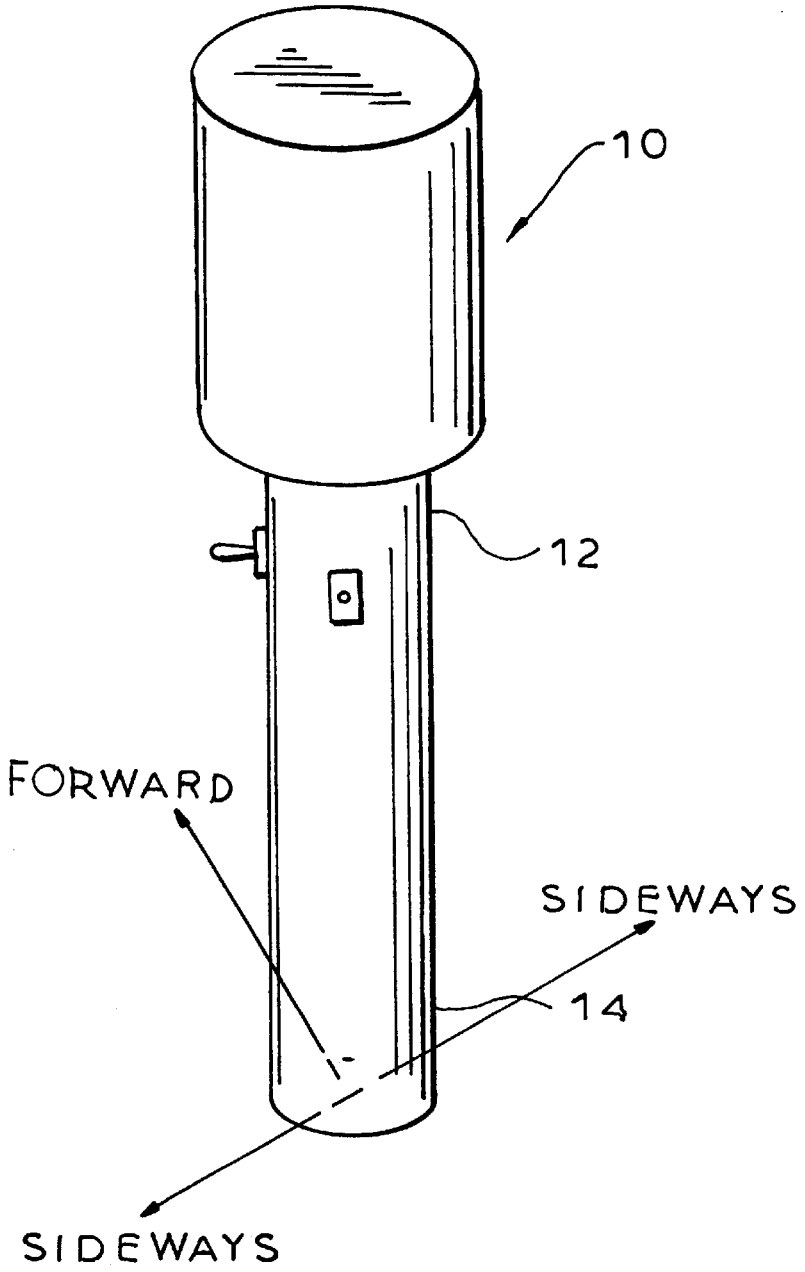
FIG. 1 is a perspective view of a toy device constructed in accordance with the present invention.
Figure 2:
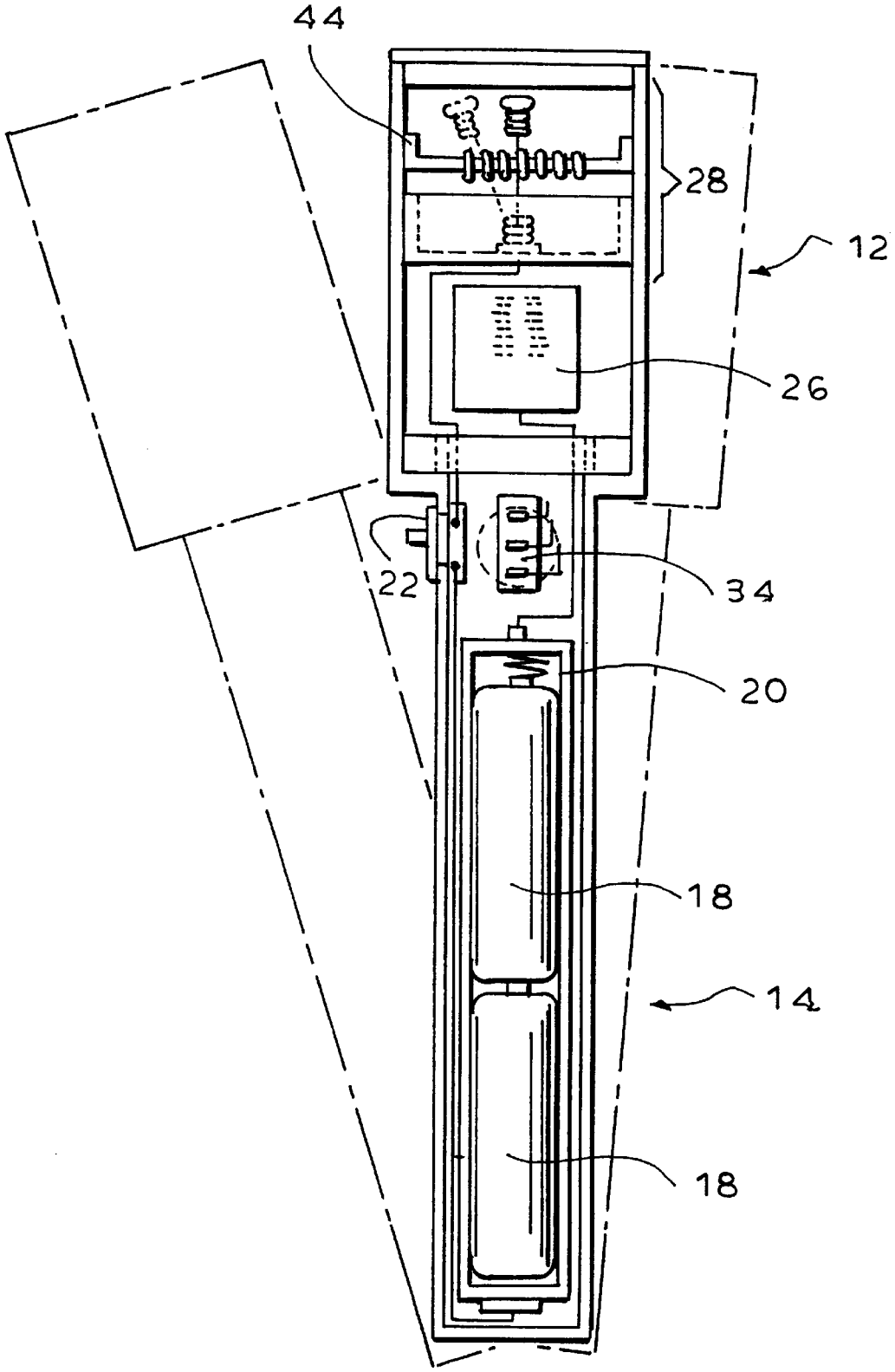
FIG. 2 is an elevation view of the interior of the housing of the toy device of FIG. 1 depicting the components arrayed therein.

As shown in FIG. 2, the baton 12 comprises a hollow housing 16 which may be constructed of an appropriate plastic, in which is mounted an electronic circuit board 26 bearing the appropriate electronic components for sound generation and storage. The handle portion or end 14, which may be of reduced diameter to accommodate a child's grip, supports a pair of 1.5 volt batteries 18, mounted in an appropriate holder 20, as well as an on/off switch 22 and a mode switch 24. The upper, enlarged head portion of the baton, in addition to supporting the circuit board 26, also supports motion sensor means 28 in the form of a switch assembly, the action of which is responsive to motions of the baton and generates a direction-responsive output to the circuitry on circuit board 26 which allows the generation of a sound corresponding to the specific direction in which the baton is moved.

Figure 3:
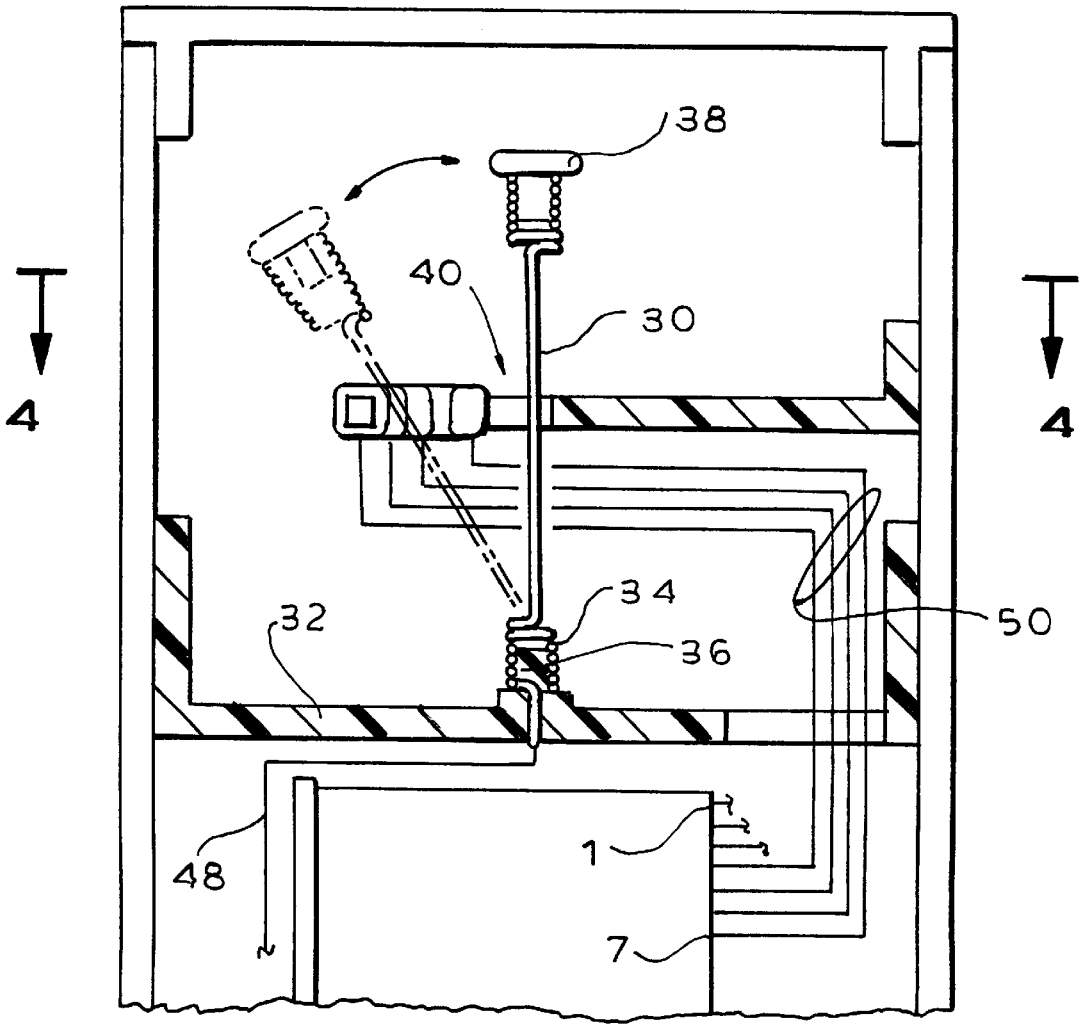
FIG. 3 is a detail elevation view of the motion-sensing means in the toy of FIG. 1.
Figure 4:
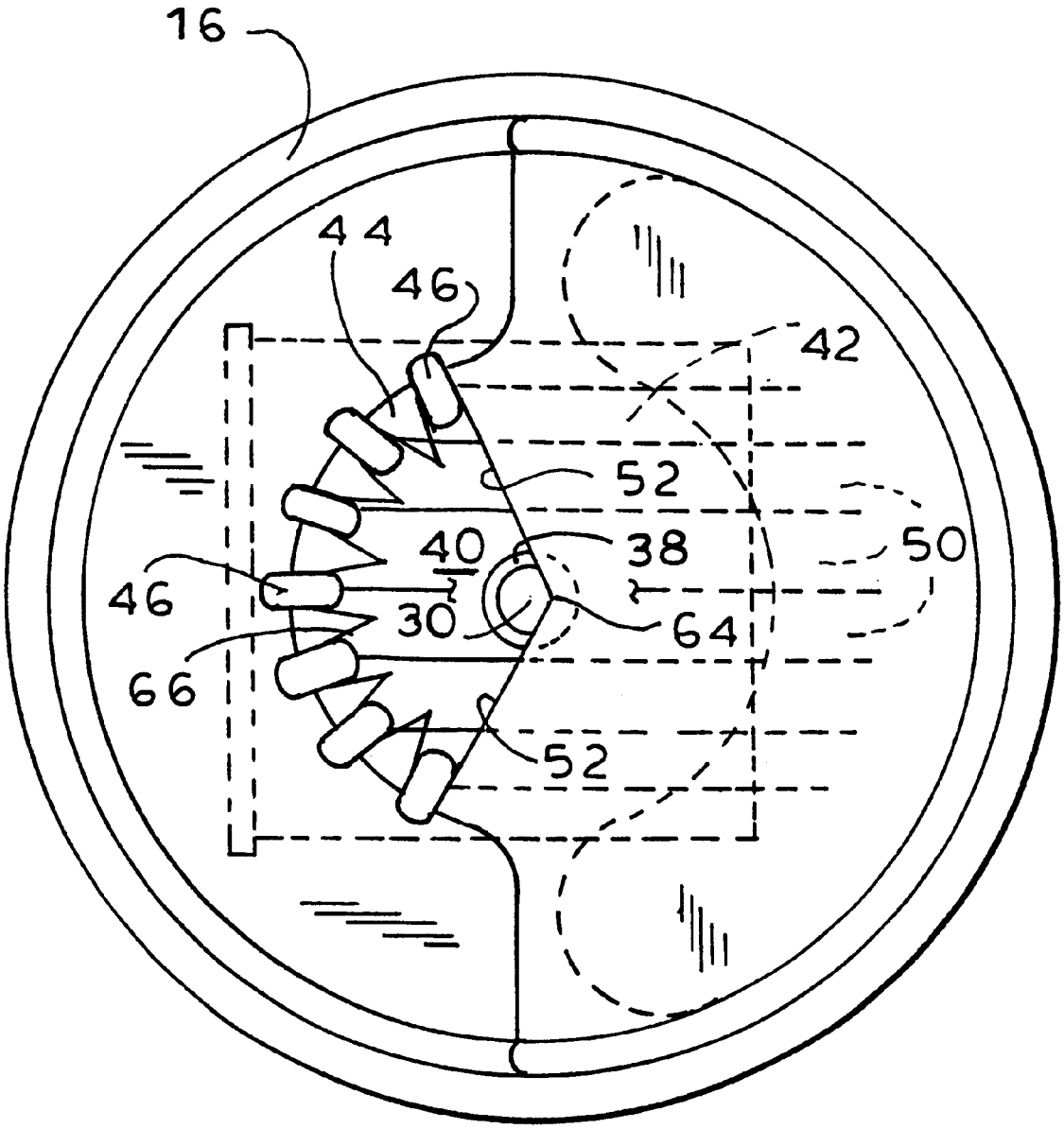
FIG. 4 is a sectional view of the motion-sensing means taken along line 4—4 of FIG. 3.

With further reference to FIGS. 3 and 4, the switch assembly may comprise an inverted pendulum which, responsive to motion of the baton, engages a particular contact to close a corresponding circuit portion. Pendulum rod 30 is mounted at its lower end to a pedestal support 32 within the housing. The rod 30, which may be in the form of a rigid conductive wire, includes at its lower end a coil spring portion 34 mounted about a circular flange portion 36 on the pedestal 32. The spring portion 34 may be integral with the rod portion 30, or may be of a material joined to the rod as appropriate. The upper end of the rod 30 supports a mass 38 which increases the rotational inertia of the pendulum about the pedestal 32. Rapid motion or displacement of the housing from a rest position can result in a relative displacement of the housing with respect to the pendulum. Other mounts, such as a free hinge or bearing, can be used to support the pendulum. Other switch configurations, incorporating magnetic reed switches, proximity or tilt switches or sensors and the like may alternatively be used for the motion sensing means.

As may be seen in FIG. 4, the normal rest position for the pendulum is extending upwardly through an aperture 40 in switch contact support armature 42 which is located above the pedestal mount 32 for the pendulum. Mounted about a peripheral portion 44 of the armature 42 are a series of electrical contacts 46. Depending upon the direction of motion of the housing, the pendulum, through the action of coil spring portion 34, pivots and contacts one of the switch contacts 46. A first electrical lead 48 connects with the pendulum, while a series of second electrical leads 50 connects with the individual switch contacts 46, both the first and second leads connecting as appropriate to the circuit board 26, as will be discussed infra. When the baton is subject to a pivoting motion about its handle portion along a vertical plane in which both the pivoting rod and a switch contact 46 are found, the inertial effects associated with the motion and acceleration allow contact between the rod and switch contact, followed by the return of the mass and rod to the equilibrium position. While those skilled in the art may recognize that it is acceleration of the housing, whether rotational or linear, resulting from a force applied to the housing by the user, which results in relative displacement between the housing and pendulum, the term "motion" or "relative motion" is to be understood to connote such action irrespective of how such motion is achieved.

As best seen in FIG. 4, the switch contacts may be, for example, seven in number, spaced about an arc of approximately 140 degrees in a plane perpendicular to the equilibrium axis of the pendulum rod 30 as established by the armature 42. Arranging the contacts over an arc of less than 180 degrees may be preferred, as it avoids the risk of multiple contacts with opposed switch contacts being generated by an oscillating motion of the pendulum as it is displaced from and subsequently returns to its rest position. In the embodiment shown, the aperture 40 through which the rod extends is bounded by a pair of flat angled wall surfaces 52 extending radially from a vertex 64 and which subtend the an arc corresponding to the arc of 140 degrees over which the contacts are spaced. The vertex 64 of the angle formed by the walls 52 aligns with the equilibrium position for the pendulum. The walls 52 both prevent the pendulum from moving in directions away from the switch contacts, directing such movement towards the contacts, and assists in damping the motion of the pendulum, allowing the pendulum to more quickly return to the equilibrium position by the restoring action of the coil spring 34.

The contacts 46 are equally spaced along the peripheral portion 44 of the armature. The inward-facing surface of the peripheral portion is formed with a series of inwardly-directed spaced teeth or points 66, the contacts being positioned between the teeth such that, as the pendulum rod 38 approaches the contacts, it is directed by a tooth towards a contact, thus assuring that an electrical contact is made between the pendulum and a contact 46 irrespective of the particular path towards the contacts taken by the pendulum within the arc defined by the end walls 52. Preferably, the teeth divide the peripheral portion 44 into a series of equal segments, such that each contact can be engaged by the pendulum, over an equal arcuate measure. It is to be recognized, however, that alternative arrangements for the switch contacts 46 are possible, including having them arrayed in larger or fewer number about a greater or lesser circumference of arc.

Figure 5:
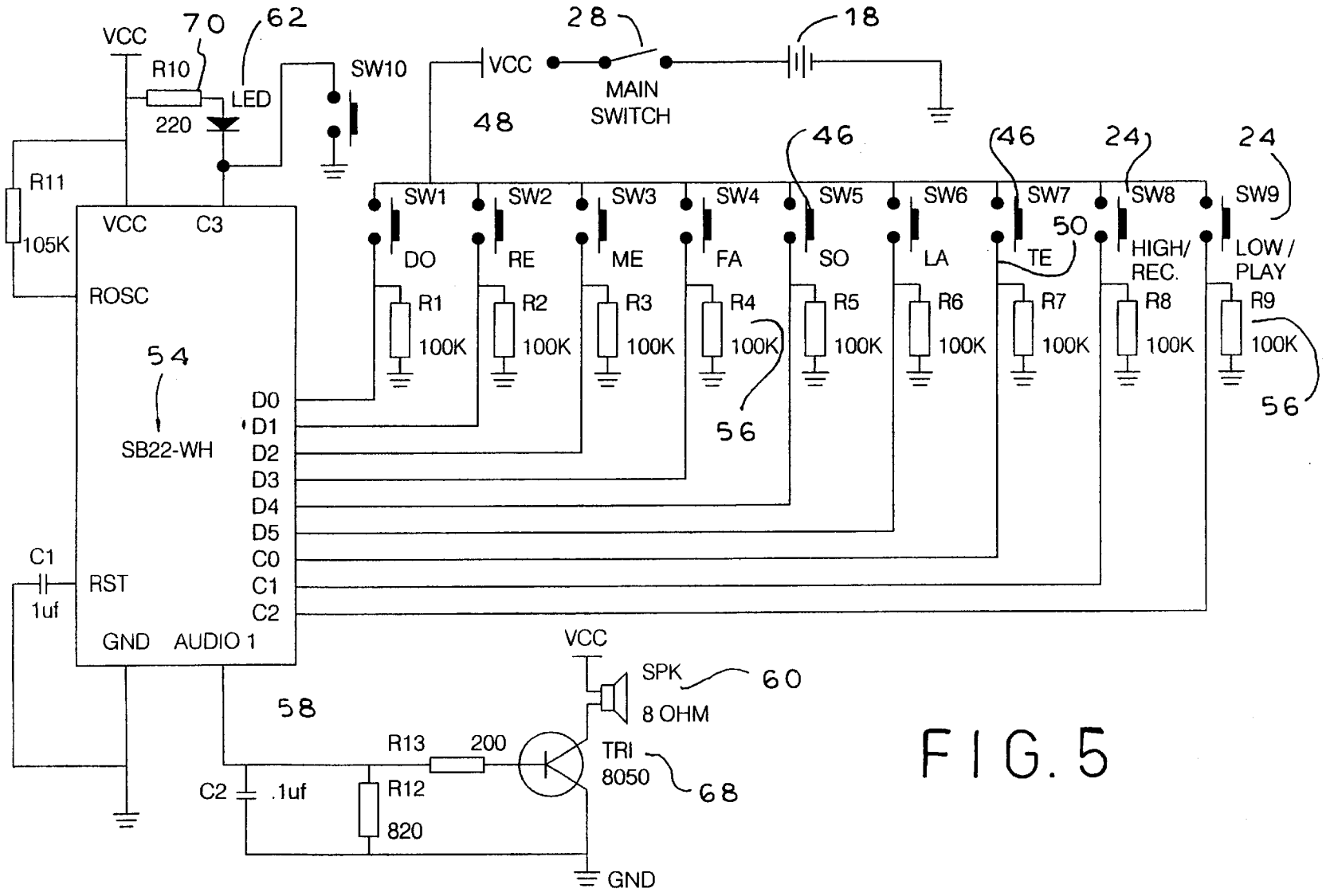
FIG. 5 is a schematic of the electrical circuitry and components employed in the toy.

FIG. 5 depicts a schematic diagram for the electronic circuitry utilized in the invention. The core of the circuitry is embodied in integrated circuit 54, which may be an SB22-WH multiple tone generator. Inputs $C_0$ and $D^0$–$D_5$ each control the generation of a particular frequency tone when coupled to $V_{cc}$. Each input is connected to a pendulum switch contact 46, also identified in FIG. 5 as a one of $SW_1$–$SW_7$, respectively, by a lead 50 as shown in FIG. 3. The first lead 48 from the pivoting rod 30 of the pendulum is coupled to $V_{cc}$, the two 1½ volt batteries 18. In series with the batteries 18 is main switch 28 which allows power to be applied to the circuit. Each of the inputs is also connected to ground by a 100K isolating resistor $R_1$–$R_7$, respectively. Inputs $C_1$ and $C_2$ control the overall frequency range for the generated tones, and are similarly coupled to $V_{cc}$ through single pole double throw mode switch 24, shown in FIG. 5 as a pair of individual switches $SW_8$, $SW_9$. $C_1$ and $C_2$ are also connected to ground by their respective isolating resistors $R_8$ and $R_9$. Mode switch 24 alternatively places input $C_1$ or $C_2$ at $V_{cc}$ to establish the tone range. As shown, the tones generated correspond to notes of an octave, the location of the octave across the audio frequency range being controlled by mode switch 24.

The audio output generated by integrated circuit 54 appears on output line 58 which is coupled to speaker 60 through a single stage amplifier configured about transistor 68, an 8050 NPN device as known in the art. The remaining components shown in the figure are as known in the art and are provided for proper configuration of the integrated circuit. They may include a series string of resistor 70 and led 62 which flashes as a tone is generated. The led may be internal to the baton housing, or may be provided to be visible from the exterior.

In addition to the generation and concurrent playback of the tones as the baton is moved, the integrated circuit 54 may allow the generated tones to be stored for playback. A tone memory capable of storing 32 tones or tones over an interval of 15 seconds may be appropriate. With the integrated circuit shown, switch $SW_{10}$, connected between input $C_3$ and ground, activates the tone memory when pressed simultaneously with switch 24 being in the $SW_8$-on position. Playback of recorded tones occurs when switch $SW_{10}$ is depressed with switch 24 being in the $SW_9$-on position. Those skilled in the art will recognize that the memory function can alternatively be accommodated by a separate device.

As depicted in FIG. 5, the electrical components, with the exception of switches 24 and 28, batteries 18 and multiple switch contact 46, may be mounted on printed circuit board 26, although it may be desirable to mount speaker 60 on an external wall of the housing to improve sound transmission.

The tone-generating circuitry may further include logic to generate a series of tones, rather than an individual tone, in response to the activation of a switch contact 46 upon baton motion. This can allow the generation of more complicated tone patterns and may further improve the play value of the apparatus. Further, the tone-generating circuitry may include means whereby the "voicing" of the generated tones may be varied, to allow, for example, the sounds of various instruments to be mimicked by the device. Appropriate switching can be provided to allow the user to choose the voicing desired.

It will be appreciated by those skilled in the art that other modifications and variations to the invention can be achieved without departing from the true scope thereof.

I claim:

1. A tone-generating apparatus, comprising a housing; tone-generating means mounted to the housing for electronically generating a plurality of different tones or tone sequences, each tone or tone sequence associated with a corresponding one of a plurality of inputs; and motion sensing means comprising an inverted electrical pendulum switch responsive to motion of said housing in a plurality of directions coupled to said plurality of inputs whereby a different tone or tone sequence is generated in response to motion of the housing in one of said plurality of directions coupled to said plurality of inputs whereby a different tone or tone sequence is generated in response to motion of the housing in one of said plurality of directions.

2. The apparatus of claim 1 wherein the inverted pendulum switch comprises an upstanding pendulum rod surrounded by a plurality of switch contacts arranged about an arc.

3. The apparatus of claim 2 wherein the switch contacts are arranged about an arc lying in a plane perpendicular to an equilibrium axis of the pendulum rod.

4. The apparatus of claim 3 wherein the pendulum rod is mounted to a pedestal supported by the housing.

5. The apparatus of claim 4 wherein the pendulum rod is mounted to the pedestal by a spring.

6. The apparatus of claim 1 further including electrical storage means for storing a sequence of tones or tone sequences generated by the tone-generating means for later playback.

7. A tone-generating apparatus, comprising a housing; tone-generating means mounted to the housing for electronically generating a plurality of different tones or tone sequences, each tone or tone sequence associated with a corresponding one of a plurality of inputs; and input generating device for said tone-generating means comprising a pendulum extending upright in the housing and pivotable between an equilibrium position and a plurality of displaced positions each having an electrical contact for contact with a respective electrical contact to generate a respective input for the tone-generating means whereby a different tone or tone sequence is generated in response to motion of the pendulum.

8. The tone-generating apparatus of claim 7 wherein the pendulum is mounted at a first, lower end thereof to a pedestal within the housing.

9. The tone-generating apparatus of claim 8 wherein the pendulum is mounted to the pedestal by a spring element.

10. The tone-generating apparatus of claim 8 wherein said pendulum extends upwardly through an aperture in an armature within said housing, the electrical contacts being mounted about a periphery of the aperture.

11. The tone-generating apparatus of claim 10 wherein the aperture is bounded by a pair of armature walls extending from a vertex aligned with the equilibrium position of the pendulum and arcuate peripheral portion of the armature.

12. The tone-generating apparatus of claim 11 wherein the armature walls form an angle of less than 180 degrees.

13. The tone generating apparatus of claim 11 wherein the angle is about 140 degrees.

14. The tone-generating apparatus of claim 11 wherein an inner surface of the arcuate peripheral portion of the armature is formed with a series of spaced teeth, the electrical contacts being located on the arcuate peripheral portion between the teeth.

15. The tone-generating apparatus of claim 11 wherein the teeth divide the arcuate peripheral portion into a series of equal segments.

* * * * *